US008529101B2

(12) United States Patent
Chen et al.

(10) Patent No.: US 8,529,101 B2
(45) Date of Patent: Sep. 10, 2013

(54) OUTDOOR LED LAMP

(75) Inventors: Te-Sheng Chen, Miao-Li (TW); Sung-Hsiang Yang, Miao-Li (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 163 days.

(21) Appl. No.: 13/325,005

(22) Filed: Dec. 13, 2011

(65) Prior Publication Data

US 2013/0148361 A1 Jun. 13, 2013

(51) Int. Cl.
*F21V 7/00* (2006.01)

(52) U.S. Cl.
USPC ..... 362/296.05; 362/431; 362/296.01

(58) Field of Classification Search
USPC ..... 362/296.05, 296.01, 431, 370, 277
See application file for complete search history.

(56) References Cited

U.S. PATENT DOCUMENTS

| | | | | |
|---|---|---|---|---|
| D553,779 | S * | 10/2007 | Butler | D26/67 |
| 7,841,734 | B2 * | 11/2010 | Wilcox | 362/153 |
| 2012/0268948 | A1 * | 10/2012 | Yoder | 362/319 |

* cited by examiner

*Primary Examiner* — Evan Dzierzynski
(74) *Attorney, Agent, or Firm* — Altis & Wispro Law Group, Inc.

(57) ABSTRACT

An exemplary outdoor LED lamp includes a post, an LED module, two supporting arms and a reflector. The LED module is mounted on a top end of the post for generating upward light. The supporting arms are mounted on the post and located at lateral sides of the LED module. The reflector is rotatably mounted on the supporting arms and located over a top side of the LED module for reflecting the upward light of the LED module.

19 Claims, 3 Drawing Sheets

OUTDOOR LED LAMP

BACKGROUND

1. Technical Field

The present disclosure relates to lamps, and more particularly to an outdoor light emitting diode (LED) lamp having adjustable illumination angle.

2. Description of Related Art

With the features of long-term reliability, environment friendliness and low power consumption, LED is viewed as a promising alternative for future outdoor lighting products.

However, once an outdoor LED lamp is fixed under a determined circumstance, a direction of a light emitted by the LED lamp cannot be changed to meet different requirements. Generally, when it is necessary to change the illumination direction, the outdoor LED lamp must be remounted or redesigned, which is unduly time-consuming and raises production costs.

Accordingly, it is desirable to provide an outdoor LED lamp which can overcome the described limitations.

DETAILED DESCRIPTION

Figure 1:
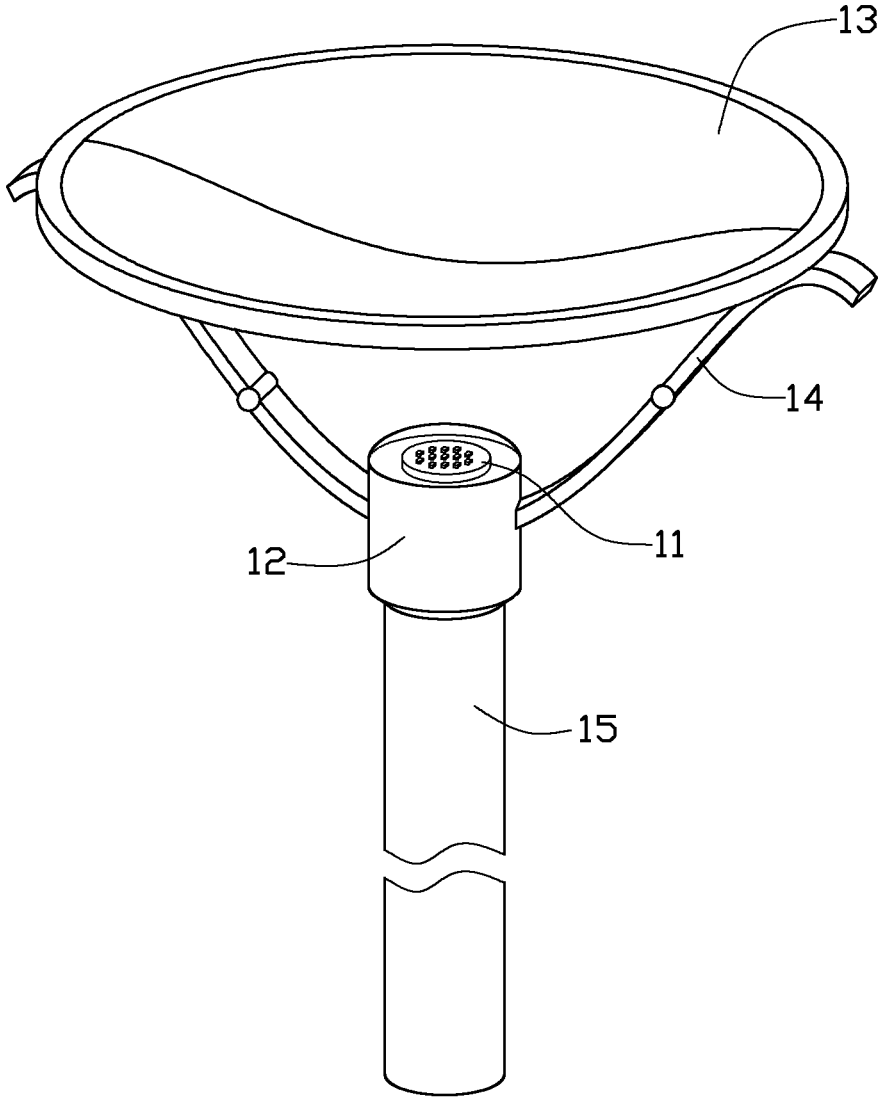
FIG. 1 is an isometric, assembled view of an outdoor LED lamp of a first embodiment of a present disclosure.

Referring to FIG. 1, an outdoor LED lamp according to a first embodiment of the present disclosure includes a post 15, an LED module 11 mounted on a top end of the post 15, a pair of supporting arms 14 mounted on lateral sides of the post 15 and a reflector 13 mounted on top ends of the supporting arms 14.

Figure 2:
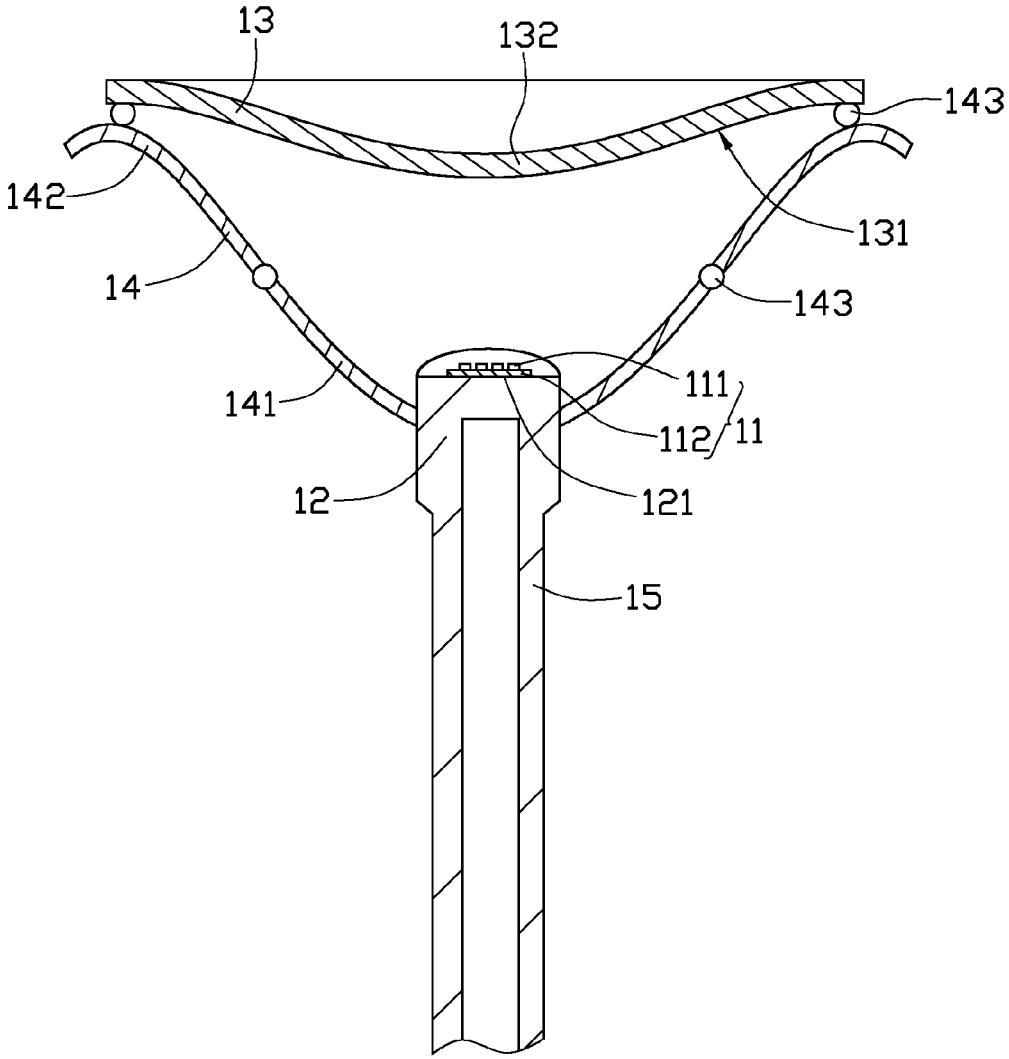
FIG. 2 is a cross-sectional view of the outdoor LED lamp of FIG. 1.

Referring also to FIG. 2, the LED module 11 includes a disc-like printed circuit board (PCB) 112 and a plurality of LEDs 111 mounted on a top surface of the PCB 112.

The post 15 is a hollow cylinder for wires (not shown) extending therethrough to connect the LED module 11 to an external power source (not shown). A top portion of the post 15 is larger than the other part of the post 15 to form a mounting part 12 thereon. The mounting part 12 includes a top plate 121. The PCB 112 of the LED module 11 is mounted on a central portion of the top plate 121.

The two supporting arms 14 are located at lateral sides of the mounting portion 12 of the post 15 and cooperatively formed a substantially V-shaped configuration. Each supporting arm 14 includes a first portion 141 and a second portion 142. The first portion 141 and the second portion 142 are curved. The first portion 141 has a concave surface facing the LED module 11. The second portion 142 has a convex surface facing the LED module 11. A bottom end of the first portion 141 is inserted in the mounting part 12 of the post 15. A top end of the first portion 141 and a bottom end of the second portion 142 pivotally engage with each other via a pivot 143. Therefore, the second portion 142 can rotates relative to the first portion 141. A top end of the second portion 142 and an edge of the reflector 13 pivotally engage with each other via another pivot 143. Therefore, the reflector 13 can rotates relative to the second portion 142 of the supporting arm 14. Thus, the reflector 13 can rotates to different positions relative to the LED module 11 to reflect light of the LED module 11 to different directions, which adjusts an illumination angle of the outdoor LED lamp.

The reflector 13 has a disc-like configuration and is located over the LED module 11. A size of the reflector 13 is larger than that of the LED module 11. The edge of the reflector 13 pivotally engages with the top ends of the supporting arms 14 via the pivots 143 therebetween. A central portion of the reflector 13 protrudes towards the LED module 11 to form a concave protrusion portion 132. Light emitted from the LED module 11 will be diffused to the environment by the reflector 13. A reflecting film 131 is formed on a bottom surface of the reflector 13 which faces the LED module 11 to enhance a reflecting efficiency of the reflector 13. The film 131 is a nano-material.

Figure 3:
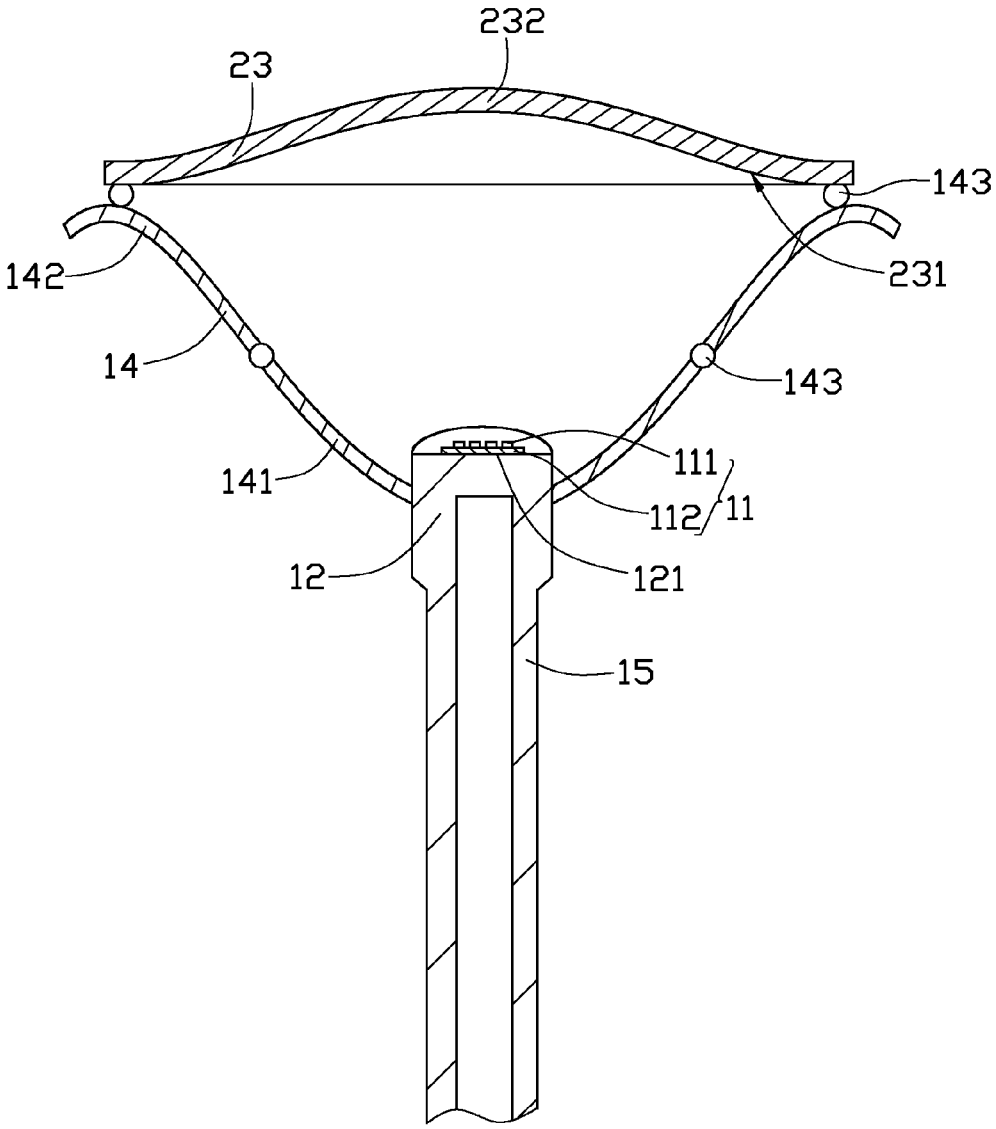
FIG. 3 is a cross-sectional view of an outdoor LED lamp of a second embodiment of the present disclosure.

Referring to FIG. 3, an outdoor LED lamp of a second embodiment of the present disclosure is shown. The outdoor LED lamp is similar to the LED lamp of the first embodiment except the reflector 23. In this embodiment, the reflector 23 has a central portion of the reflector 23 protruding away from the LED module 11 to form a convex protrusion portion 232. A reflecting film 231 can also be formed on a bottom surface of the reflector 23 which faces the LED module 11 to enhance a reflecting efficiency of the reflector 23.

As described in the embodiments, the LED module 11 is disposed on a top end of the post 15, thus almost all of the light emitted by the LEDs 111 goes upwards. The reflector 13, 23 arranged over the LED module 11 reflects the light of LEDs 111 to the environment needing illumination. The reflector 13, 23 is rotatable relative to the LED module 11, it can be at different positions relative to the LED module 11 to reflect the light to anywhere needs illumination of the LED module 11, without redesign of the LED lamp.

It is to be understood, however, that even though numerous characteristics and advantages of the disclosure have been set forth in the foregoing description, together with details of the structure and function of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An outdoor LED lamp comprising:

a post;

an LED module mounted on a top end of the post for generating upward light;

a supporting arm mounted on the post; and a reflector mounted on the supporting arm and located over the LED module for reflecting the upward light of the LED module, the reflector being rotatable relative to the LED module.

2. The outdoor LED lamp of claim 1, wherein a reflecting film is formed on a bottom surface of the reflector facing the LED module.

3. The outdoor LED lamp of claim 2, wherein the reflecting film is a nano-material.

4. The outdoor LED lamp of claim 1, wherein the reflector has a disc-like configuration and a central portion thereof protrudes towards the LED module to form a concave protrusion portion.

5. The outdoor LED lamp of claim 1, wherein the reflector has a disc-like configuration and a central portion thereof protrudes away from the LED module to form a convex protrusion portion.

6. The outdoor LED lamp of claim 1, wherein the supporting arm comprises a first portion and a second portion, a bottom end of the first portion is mounted on the post, an a top end of the first portion and a bottom end of the second portion pivotally engage with each other via a pivot.

7. The outdoor LED lamp of claim 6, wherein a top end of the second portion and an edge of the reflector pivotally engage with each other via another pivot.

8. The outdoor LED lamp of claim 7 further comprising another supporting arm, wherein the two supporting arms are located at lateral sides of the post and cooperatively form a substantially V-shaped configuration to support the reflector on a top thereof.

9. The outdoor LED lamp of claim 1, wherein the post is a hollow cylinder.

10. The outdoor LED lamp of claim 1, wherein the LED module comprises a printed circuit board mounted on the post and a plurality of LEDs mounted on the printed circuit board.

11. An outdoor LED lamp comprising:

a post;

an LED module mounted on a top end of the post;

a supporting arm mounted on the post; and a reflector mounted on the supporting arm and located over the LED module, the reflector being pivotally connected to the supporting arm and being rotatable relative to the supporting arm.

12. The outdoor LED lamp of claim 11, wherein the reflector is pivotally connected to the supporting arm via a pivot.

13. The outdoor LED lamp of claim 11, wherein the supporting arm comprises a first portion and a second portion, a bottom end of the first portion is mounted on the post, a top end of the first portion and a bottom end of the second portion pivotally engage with each other via another pivot located at therebetween, and a top end of the second portion and the reflector pivotally engage with each other via the pivot.

14. The outdoor LED lamp of claim 12 further comprising another supporting arm, wherein the two supporting arms are located at lateral sides of the post and cooperatively form a substantially V-shaped configuration to support the reflector on a top thereof.

15. The outdoor LED lamp of claim 11 further comprising another supporting arm, wherein the two supporting arms are located at lateral sides of the post and cooperatively formed a substantially V-shaped configuration to support the reflector on a top thereof, and the two supporting arms pivotally engage the reflector via two pivots located at therebetween.

16. An outdoor LED lamp comprising:

a post;

an LED module mounted on a top end of the post for generating upward light;

a supporting arm mounted around the post; and a reflector mounted on the supporting arm and located over the LED module reflecting the upward light of the LED module;

wherein the supporting arm comprises a first portion extending from the pole and a second portion pivotally connected to the first portion, and the reflector is connected to the second portion.

17. The outdoor LED lamp of claim 16, wherein a top end of the second portion and an edge of the reflector pivotally engage with each other via a pivot located therebetween.

18. The outdoor LED lamp of claim 16, wherein a bottom end of the second portion and a top end of the first portion of the supporting arm pivotally engage with each other via a pivot located at therebetween.

19. The outdoor LED lamp of claim 16 further comprising another supporting arm, wherein the two supporting arms are located at lateral sides of the post and cooperatively formed a substantially V-shaped configuration to support the reflector on a top thereof.

* * * * *